US012509847B2

(12) United States Patent
Tsunekawa et al.

(10) Patent No.: US 12,509,847 B2
(45) Date of Patent: Dec. 30, 2025

(54) WORK MACHINE ARM, WORK IMPLEMENT, AND WORK MACHINE

(71) Applicant: KOMATSU LTD., Tokyo (JP)

(72) Inventors: Atsushi Tsunekawa, Tokyo (JP); Ahmad Iskandar, Tokyo (JP); Takuya Izaki, Tokyo (JP); Akinobu Iwasaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 177 days.

(21) Appl. No.: 18/281,383

(22) PCT Filed: Feb. 24, 2022

(86) PCT No.: PCT/JP2022/007599
§ 371 (c)(1),
(2) Date: Sep. 11, 2023

(87) PCT Pub. No.: WO2022/196279
PCT Pub. Date: Sep. 22, 2022

(65) Prior Publication Data

US 2024/0150993 A1 May 9, 2024

(30) Foreign Application Priority Data

Mar. 15, 2021 (JP) ..... 2021-041388

(51) Int. Cl.
*E02F 3/36* (2006.01)
*E02F 3/38* (2006.01)
*E02F 9/22* (2006.01)

(52) U.S. Cl.
CPC ..... *E02F 3/38* (2013.01); *E02F 3/369* (2013.01); *E02F 9/2271* (2013.01)

(58) Field of Classification Search
CPC ..... E02F 3/38; E02F 3/369; E02F 9/2271
USPC ..... 414/722
See application file for complete search history.

(56) References Cited

U.S. PATENT DOCUMENTS

| | | | | |
|---|---|---|---|---|
| 2007/0124963 | A1* | 6/2007 | Ishikawa | E02F 3/38 37/446 |
| 2014/0334906 | A1* | 11/2014 | Takahashi | E02F 9/006 414/727 |
| 2015/0003949 | A1* | 1/2015 | Kusama | E02F 9/2275 414/722 |
| 2020/0392694 | A1* | 12/2020 | Hannetel | E02F 3/38 |

FOREIGN PATENT DOCUMENTS

| | | | | |
|---|---|---|---|---|
| CN | 109024725 | A | | 12/2018 |
| EP | 3733976 | A1 | | 11/2020 |
| JP | H07-031952 | U | | 6/1995 |
| JP | 2003003511 | A | * | 1/2003 |
| JP | 2012-241422 | A | | 12/2012 |
| JP | 2013-147794 | A | | 8/2013 |
| JP | 2015-010386 | A | | 1/2015 |
| JP | 2017-226992 | A | | 12/2017 |

* cited by examiner

*Primary Examiner* — Gerald McClain
(74) *Attorney, Agent, or Firm* — Faegre Drinker Biddle & Reath LLP

(57) ABSTRACT

An arm cylinder bracket (7*a*) is connected to a lower plate (BP). An inner rib (21) is disposed inside an arm (7) and connected to the lower plate (BP) within a connection range (RA) between the lower plate (BP) and the arm cylinder bracket (7*a*) in a side view.

8 Claims, 5 Drawing Sheets

WORK MACHINE ARM, WORK IMPLEMENT, AND WORK MACHINE

TECHNICAL FIELD

The present disclosure relates to a work machine arm, a work implement, and a work machine.

BACKGROUND ART

Conventionally, a configuration of a hydraulic excavator including an arm having a partition wall inside thereof has been disclosed, for example, in Japanese Patent Laying-Open No. 2012-241422 (PTL 1) and Japanese Utility Model Laying-Open No. 07-31952 (PTL 2). In the above-mentioned two literatures, the partition wall inside the arm is in contact with a boss (a boom coupling boss) to which a distal end of a boom is coupled.

CITATION LIST

Patent Literature

PTL 1: Japanese Patent Laying-Open No. 2012-241422
PTL 2: Japanese Utility Model Laying-Open No. 07-31952

SUMMARY OF INVENTION

Technical Problem

In the arm in each of the above-mentioned two literatures, when excavation is performed at a high elevation site while an arm cylinder is retracted to the maximum extent, a load received from the arm cylinder may cause high stress in a portion at which the arm is joined.

It is an object of the present disclosure to provide a work machine arm, a work implement, and a work machine that are capable of suppressing occurrence of high stress in an arm even when excavation is performed at a high elevation site while an arm cylinder is retracted to the maximum extent.

Solution to Problem

A work machine arm according to the present disclosure includes a lower plate, an upper plate, an arm cylinder bracket, and a first inner rib. The lower plate includes a first outer surface and a first inner surface facing each other. The upper plate includes a second outer surface and a second inner surface facing each other, and is disposed such that the second inner surface faces the first inner surface at a distance from the first inner surface. The arm cylinder bracket is connected to the first outer surface of the lower plate. The first inner rib is disposed between the lower plate and the upper plate, and connected to the first inner surface of the lower plate within a connection range between the lower plate and the arm cylinder bracket in a side view.

A work implement according to the present disclosure includes the work machine arm and an arm cylinder connected to the arm cylinder bracket of the work machine arm.

A work machine according to the present disclosure includes the work implement and a main body that supports the work implement.

Advantageous Effects of Invention

The present disclosure can achieve a work machine arm, a work implement, and a work machine that are capable of suppressing occurrence of high stress in an arm even when excavation is performed at a high elevation site while an arm cylinder is retracted to the maximum extent.

DESCRIPTION OF EMBODIMENTS

Figure 1:
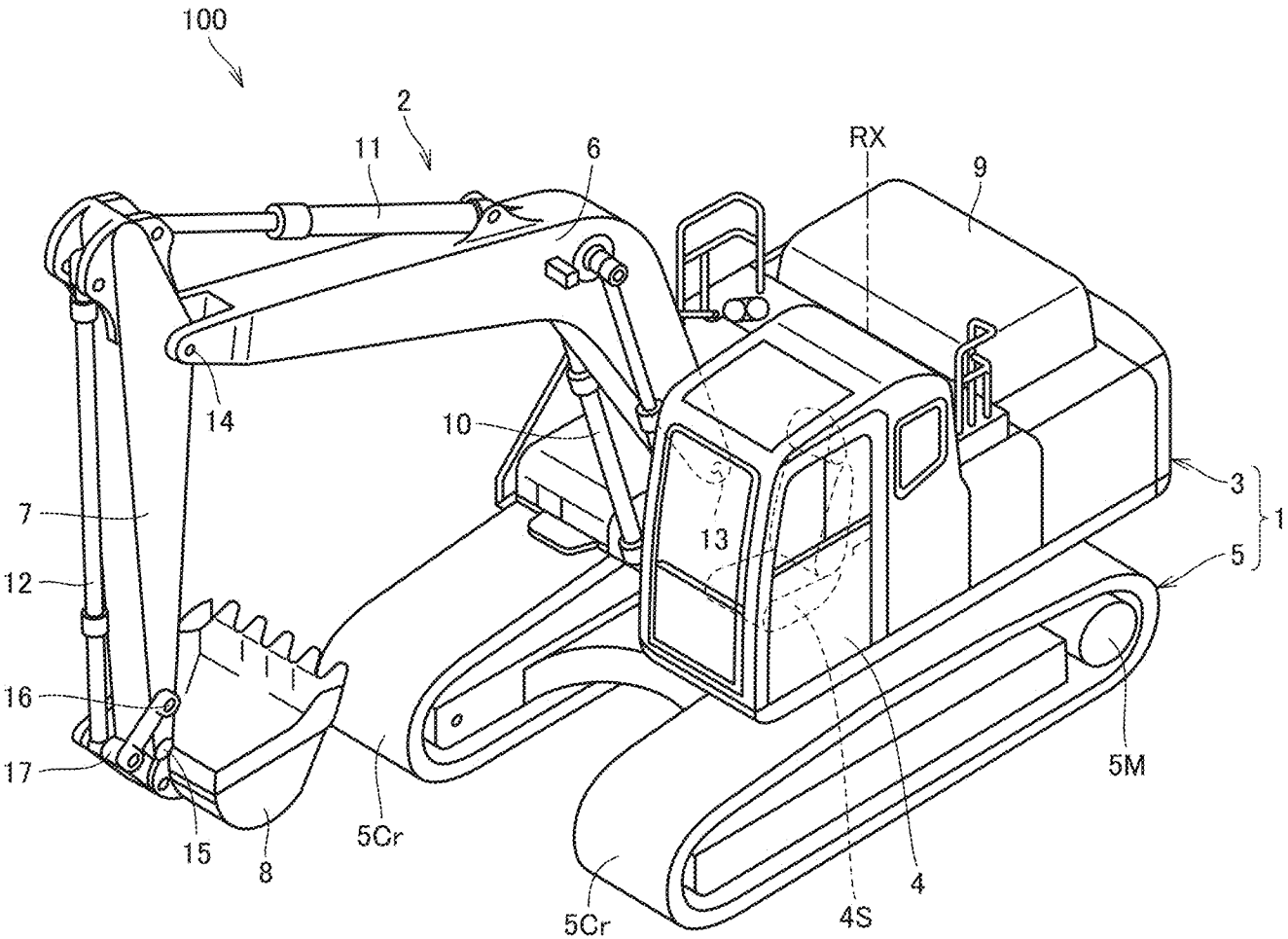
FIG. 1 is a perspective view schematically showing a configuration of a work machine in an embodiment of the present disclosure.

An embodiment of the present disclosure will be hereinafter described with reference to the accompanying drawings.

In the specification and the accompanying drawings, the same or corresponding components are denoted by the same reference characters, and the same description will not be repeated. Further, in the accompanying drawings, the configuration may be omitted or simplified for the sake of explanation. Further, at least a part of each embodiment and each modification may be arbitrarily combined with each other.

The present disclosure is applicable to any work machine as long as it includes an arm in addition to a hydraulic excavator. In the following description, the terms "upper", "lower", "front", "rear", "left", and "right" indicate the directions with reference to an operator seated on an operator's seat 4S in an operator's cab 4 shown in FIG. 1.

<Configuration of Work Machine>

The following first describes a configuration of a work machine according to the present embodiment with reference to FIG. 1.

FIG. 1 is a perspective view schematically showing a configuration of a work machine in an embodiment of the present disclosure. As shown in FIG. 1, a hydraulic excavator 100 includes a main body 1 and a work implement 2 that operates with hydraulic pressure. Main body 1 includes a revolving unit 3 and a traveling unit 5. Traveling unit 5 includes a pair of crawler belts 5Cr and a traveling motor 5M. Hydraulic excavator 100 can travel as crawler belts 5Cr rotate. Traveling motor 5M is provided as a driving source of traveling unit 5. Traveling motor 5M is a hydraulic motor that is actuated with hydraulic pressure. Note that traveling unit 5 may include wheels (tires).

Revolving unit 3 is disposed on traveling unit 5 and supported by traveling unit 5. Revolving unit 3 is revolvable with respect to traveling unit 5 about a revolving axis RX. Revolving unit 3 includes an operator's cab 4 (*cab*). Operator's cab 4 is equipped with an operator's seat 4S on which an operator is seated. The operator (occupant) who is aboard operator's cab 4 can manipulate work implement 2, can manipulate revolving unit 3 to revolve with respect to traveling unit 5, and can manipulate hydraulic excavator 100 to travel with the help of traveling unit 5.

Revolving unit 3 includes an engine cover 9 and a counterweight that is provided in a rear portion of revolving unit 3. Engine cover 9 covers an engine room. In the engine room, an engine unit (an engine, an exhaust treatment structure, and the like) is disposed.

Work implement 2 is supported by revolving unit 3. Work implement 2 includes a boom 6, an arm 7, and a bucket 8. Work implement 2 further includes a boom cylinder 10, an arm cylinder 11, and a bucket cylinder 12.

Boom 6 is pivotably connected to main body 1 (traveling unit 5 and revolving unit 3). Specifically, a proximal end portion of boom 6 is pivotably connected to revolving unit 3 about a boom foot pin 13 as a pivot point.

Arm 7 is pivotably connected to boom 6. Specifically, a proximal end portion of arm 7 is pivotably connected to a distal end portion of boom 6 about a boom top pin 14 as a pivot point. Bucket 8 is rotatably connected to arm 7. Specifically, a proximal end portion of bucket 8 is pivotably connected to a distal end portion of arm 7 about an arm top pin 15 as a pivot point.

Boom cylinder 10 has one end connected to revolving unit 3 and the other end connected to boom 6. Boom 6 can be driven by boom cylinder 10 with respect to main body 1. Boom 6 driven in this way can pivot in the up-down direction with respect to revolving unit 3 about boom foot pin 13 as a pivot point.

Arm cylinder 11 has one end connected to boom 6 and the other end connected to arm 7. Arm 7 can be driven by arm cylinder 11 with respect to boom 6. Arm 7 driven in this way can pivot in the up-down direction or in the front-rear direction with respect to boom 6 about boom top pin 14 as a pivot point.

Bucket cylinder 12 has one end connected to arm 7 and the other end connected to a bucket link 17. Bucket 8 can be driven by bucket cylinder 12 with respect to arm 7. Bucket 8 driven in this way can pivot in the up-down direction with respect to arm 7 about arm top pin 15 as a pivot point.

<Configuration of Arm>

Figure 2:
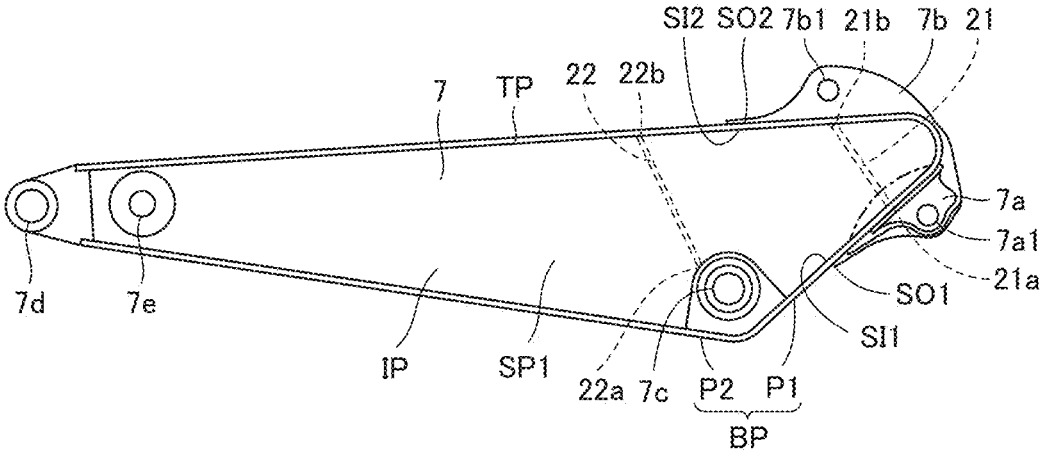
FIG. 2 is a side view showing a configuration of an arm in the work machine shown in FIG. 1.
Figure 3:
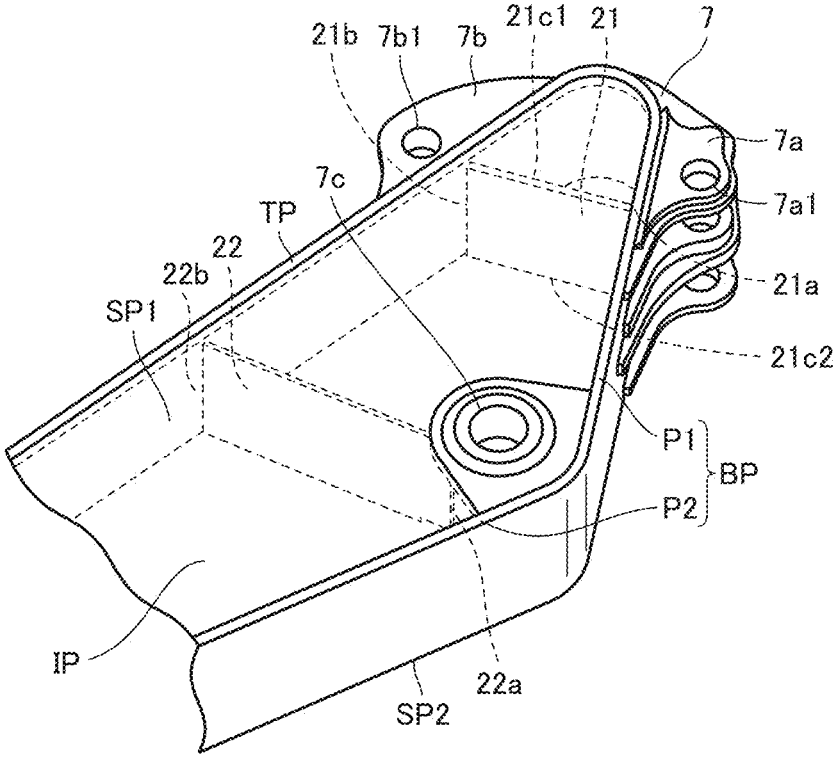
FIG. 3 is an enlarged perspective view showing, in an enlarged manner, a part of the arm shown in FIG. 2.
Figure 4:
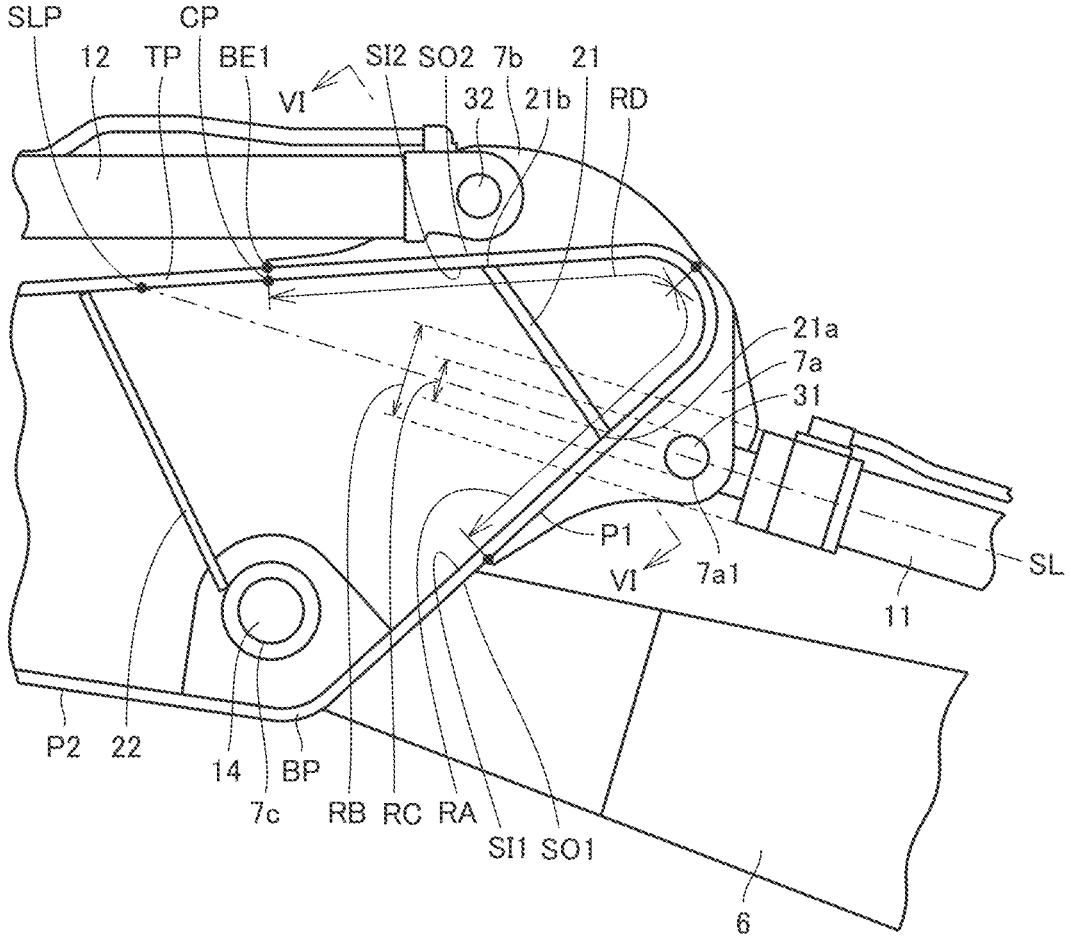
FIG. 4 is an enlarged side view for illustrating an arrangement of inner ribs.

The following describes the configuration of the arm in the present embodiment with reference to FIGS. 2 to 4.

FIG. 2 is a side view showing a configuration of the arm in the work machine shown in FIG. 1, and FIG. 3 is an enlarged perspective view showing, in an enlarged manner, a part of the arm. FIG. 4 is an enlarged side view for illustrating an arrangement of inner ribs.

As shown in FIGS. 2 and 3, arm 7 includes a lower plate BP, an upper plate TP, and a pair of side plates SP1 and SP2. Each of lower plate BP, upper plate TP, and the pair of side plates SP1 and SP2 is made of a steel material, for example.

As shown in FIG. 2, upper plate TP is located above lower plate BP in the state in which the proximal end portion and the distal end portion of arm 7 are arranged in the lateral direction (in the front-rear direction). Upper plate TP and lower plate BP face each other with a gap interposed therebetween in the up-down direction in the state in which the proximal end portion and the distal end portion of arm 7 are arranged in the lateral direction (in the front-rear direction).

As shown in FIG. 3, the pair of side plates SP1 and SP2 face each other with a gap interposed therebetween in the left-right direction. The upper end of each of the pair of side plates SP1 and SP2 is connected to upper plate TP, for example, by welding. The lower end of each of the pair of side plates SP1 and SP2 is connected to lower plate BP, for example, by welding. Each of the pair of side plates SP1 and SP2 is a flat plate, for example.

Arm 7 has a box shape having a cross section (a plane cut in the left-right direction) having a rectangular shape formed by lower plate BP, upper plate TP, and the pair of side plates SP1 and SP2 that are connected as described above. Arm 7 includes an internal space IP surrounded by lower plate BP, upper plate TP, and the pair of side plates SP1 and SP2. Internal space IP is hollow.

As shown in FIG. 2, lower plate BP has an inner surface SI1 facing internal space IP and an outer surface SO1 exposed to the outside as a back surface of inner surface SI1. Upper plate TP has an inner surface SI2 facing internal space IP and an outer surface SO2 exposed to the outside as a back surface of inner surface SI2. The pair of side plates SP1 and SP2 each has an inner surface facing internal space IP and an outer surface exposed to the outside as a back surface of the inner surface.

Upper plate TP is a flat plate, for example. Lower plate BP includes a first plate P1 and a second plate P2. First plate P1 and second plate P2 are connected to each other. Each of first plate P1 and second plate P2 is a flat plate. A connection portion between first plate P1 and second plate P2 is bent.

Arm 7 is provided with a boom coupling boss 7*c*, a bucket coupling boss 7*d*, and a link coupling boss 7*e*. Each of boom coupling boss 7*c*, bucket coupling boss 7*d*, and link coupling boss 7*e* is provided so as to penetrate through the pair of side plates SP1 and SP2.

Boom coupling boss 7*c* is a portion into which boom top pin 14 (FIG. 1) is inserted. Arm 7 is pivotably connected to the distal end portion of boom 6 about, as a pivot point, boom top pin 14 inserted into boom coupling boss 7*c*. Boom coupling boss 7*c* is disposed in the vicinity of a joining portion between first plate P1 and second plate P2 of lower plate BP.

Bucket coupling boss 7*d* is a portion into which arm top pin 15 (FIG. 1) is inserted. Bucket 8 is pivotably connected to the distal end portion of arm 7 about, as a pivot point, arm top pin 15 inserted into bucket coupling boss 7*d*. Bucket coupling boss 7*d* is disposed at the distal end portion of arm 7.

Link coupling boss 7*e* is a portion into which a link pin 16 (FIG. 1) is inserted. Bucket link 17 (FIG. 1) is supported by arm 7 with link pin 16 interposed therebetween. Link coupling boss 7*e* is disposed closer to bucket coupling boss 7*d* than to boom coupling boss 7*c*.

Arm 7 further includes an arm cylinder bracket 7*a* and a bucket cylinder bracket 7*b*. Arm cylinder bracket 7*a* serves to pivotably support the other end of arm cylinder 11 (FIG. 1). Arm cylinder bracket 7*a* is connected to outer surface SO1 of first plate P1. Arm cylinder bracket 7*a* protrudes outward from outer surface SO1 of first plate P1.

Arm cylinder bracket 7*a* has a through hole 7*a*1. Through hole 7*a*1 penetrates through arm cylinder bracket 7*a*. A pin 31 (FIG. 4) for pivotably supporting arm cylinder 11 is inserted into through hole 7*a*1.

Bucket cylinder bracket 7*b* serves to pivotably support one end of bucket cylinder 12 (FIG. 1). Bucket cylinder bracket 7*b* is connected to outer surface SO2 of upper plate TP. Bucket cylinder bracket 7*b* protrudes outward from outer surface SO2 of upper plate TP.

Bucket cylinder bracket 7*b* has a through hole 7*b*1. Through hole 7*b*1 penetrates through bucket cylinder bracket 7*b*. A pin 32 (FIG. 4) for pivotably supporting bucket cylinder 12 is inserted into through hole 7*b*1.

Arm 7 further includes an inner rib 21 (a first inner rib) and an inner rib 22 (a second inner rib). Each of inner ribs 21 and 22 is disposed inside internal space IP of arm 7.

Inner rib 22 has one end (a lower end) 22*a* connected to boom coupling boss 7*c* and the other end (an upper end) 22*b* connected to inner surface SI2 of upper plate TP. Inner rib 22 has one side end connected to the inner surface of side plate SP1 and the other side end connected to the inner surface of side plate SP2.

Inner rib 21 has a first end (a lower end) 21*a* connected to inner surface SI1 of first plate P1 and a second end (an upper end) 21*b* connected to inner surface SI2 of upper plate TP.

As shown in FIG. 3, inner rib 21 has one side end 21*c*1 connected to the inner surface of side plate SP1 and the other side end 21*c*2 connected to the inner surface of side plate SP2.

As shown in FIG. 4, in a side view, first end 21*a* of inner rib 21 is connected to inner surface SI1 of first plate P1 within a connection range RA between first plate P1 and arm cylinder bracket 7*a*. Connection range RA means a range in which a region of first plate P1 on the inner surface SI1 side that corresponds to a connection region between first plate P1 and arm cylinder bracket 7*a* on outer surface SO1 of first plate P1 is viewed from the lateral side (in the left-right direction). Also, a side view means a view seen from a viewpoint in the left-right direction with respect to an operator seated on operator's seat 4S.

In a side view, first end 21*a* of inner rib 21 may be connected to inner surface SI1 of first plate P1 within an extension region RB in which the outer shape of arm cylinder 11 retracted to the maximum extent is extended in the extending direction of an axis line SL of arm cylinder 11. Further, in a side view, first end 21*a* of inner rib 21 may be connected to inner surface SI1 of first plate P1 within an extension region RC in which the outer shape of through hole 7*a*1 is extended in the extending direction of axis line SL of arm cylinder 11 retracted to the maximum extent. Further, in a side view, first end 21*a* of inner rib 21 may be connected to inner surface SI1 of first plate P1 on an extension line of axis line SL of arm cylinder 11 retracted to the maximum extent.

The state in which arm cylinder 11 is retracted to the maximum extent means the state in which arm cylinder 11 reaches a stroke end on the retracted side.

In a side view, second end 21*b* of inner rib 21 is connected to inner surface SI2 of upper plate TP within a connection range RD between upper plate TP and bucket cylinder bracket 7*b*. Connection range RD means a range in which a region of upper plate TP on the inner surface SI2 side that corresponds to a connection region between upper plate TP and bucket cylinder bracket 7*b* on outer surface SO2 of upper plate TP is viewed from the lateral side (in the left-right direction).

In a side view, second end 21*b* of inner rib 21 may be connected to a point CP on the inner surface SI2 side of upper plate TP that corresponds to a bucket-side end portion BE1 of bucket cylinder bracket 7*b* connected to outer surface SO2 of upper plate TP.

In a side view, second end 21*b* of inner rib 21 is preferably connected to inner surface SI2 of upper plate TP at a position closer to bucket cylinder bracket 7*b* than a point SLP at which the extension line of axis line SL of arm cylinder 11 retracted to the maximum extent intersects with inner surface SI2 of upper plate TP.

<Effects>

The following describes the effects of the present embodiment.

Figure 5:
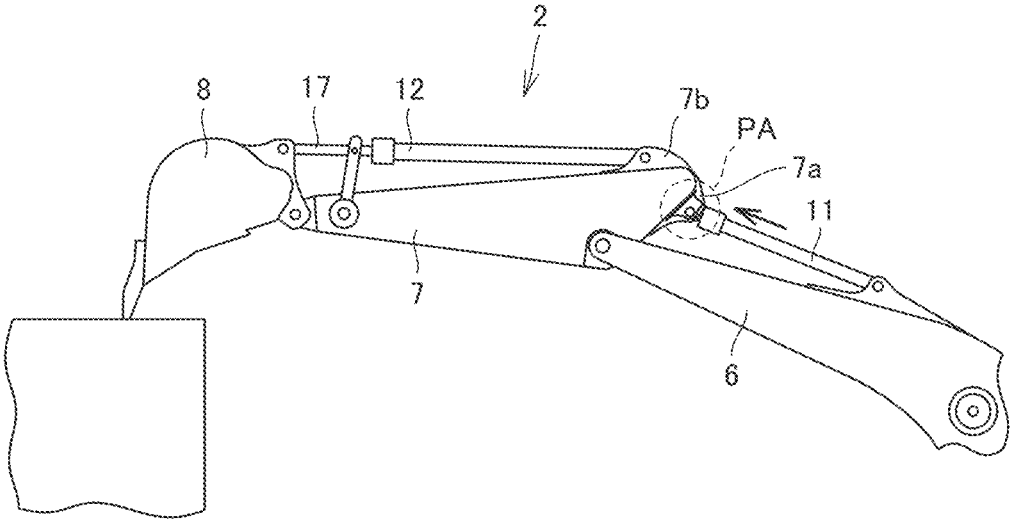
FIG. 5 is a side view showing the state of a work implement that performs excavation at a high elevation site while an arm cylinder is retracted to the maximum extent.

FIG. 5 is a side view showing the state of the work implement that performs excavation at a high elevation site while the arm cylinder is retracted to the maximum extent. As shown in FIG. 5, there may be a case, for example, where an excavation target located at a high position is hit with bucket 8 so as to be broken. In this case, excavation is performed at a high elevation site while arm cylinder 11 is retracted to the maximum extent.

During excavation, reaction force with which bucket 8 is hit against the excavation target acts on bucket 8. This reaction force is transmitted to the portion in the vicinity of the joining portion between bucket cylinder bracket 7*b* and arm 7 through bucket link 17 and bucket cylinder 12. In addition, during this excavation, arm cylinder 11 is being retracted to the maximum extent. Thus, the reaction force is not weakened by arm cylinder 11 but acts on a connection portion PA between arm cylinder bracket 7*a* and arm 7. As a result, a load received from arm cylinder 11 may cause high stress in the vicinity of arm cylinder bracket 7*a* as indicated by a dash-dotted line in FIG. 2.

On the other hand, in the present embodiment, as shown in FIG. 4, in a side view, inner rib 21 is connected to inner surface SI1 of lower plate BP within connection range RA between lower plate BP and arm cylinder bracket 7*a*. Thereby, inner rib 21 supports first plate P1 of lower plate BP from the inner surface SI1 side and shares the load received from arm cylinder 11. Thus, the stress acting on arm 7 around arm cylinder bracket 7*a* can be reduced. Thereby, occurrence of high stress in the vicinity of arm cylinder bracket 7*a* can be suppressed.

In the present embodiment, as shown in FIG. 4, inner rib 21 is connected at first end 21*a* to inner surface SI1 of lower plate BP and connected at second end 21*b* to inner surface SI2 of upper plate TP. Thereby, lower plate BP can be supported from the inner surface SI1 side by upper plate TP with inner rib 21 interposed between. Therefore, occurrence of high stress in the vicinity of arm cylinder bracket 7*a* can be suppressed.

In the present embodiment, as shown in FIG. 4, in a side view, second end 21*b* of inner rib 21 is connected to upper plate TP within connection range RD between upper plate TP and bucket cylinder bracket 7*b*. Thereby, as compared with the case where second end 21*b* of inner rib 21 is connected to inner surface SI2 of upper plate TP at a position closer to bucket 8 than connection range RD, the length of inner rib 21 is shortened, and an increase in weight of inner rib 21 can be suppressed.

In the present embodiment, as shown in FIG. 4, in a side view, second end 21*b* of inner rib 21 may be connected to position CP on inner surface SI2 of upper plate TP that corresponds to the position of bucket-side end portion BE1 of bucket cylinder bracket 7*b* connected to outer surface SO2 of upper plate TP. Thereby, the load received from arm cylinder 11 can be shared more by inner rib 21 while suppressing an increase in weight of inner rib 21.

In the present embodiment, as shown in FIG. 4, inner rib 22 is disposed between lower plate BT and upper plate TP, and connected to boom coupling boss 7*c*. Thereby, inner rib 22 can share the load received from boom 6.

In the present embodiment, as shown in FIG. 4, in a side view, first end 21*a* of inner rib 21 is connected to inner surface SI1 of first plate P1 within extension region RB in which the outer shape of arm cylinder 11 retracted to the maximum extent is extended in the direction of axis line SL of arm cylinder 11. Thereby, inner rib 21 can suppress occurrence of high stress in the vicinity of arm cylinder bracket 7*a*, in the same way as described above.

In the present embodiment, as shown in FIG. 4, in a side view, first end 21*a* of inner rib 21 is connected to inner surface SI1 of first plate P1 within extension region RC in which the outer shape of through hole 7*a*1 is extended in the direction of axis line SL of arm cylinder 11 retracted to the maximum extent. Thereby, inner rib 21 can suppress occurrence of high stress in the vicinity of arm cylinder bracket 7*a*, in the same way as described above.

In the present embodiment, as shown in FIG. 4, in a side view, first end 21*a* of inner rib 21 is connected to inner surface SI1 of first plate P1 on the extension line of axis line SL of arm cylinder 11 retracted to the maximum extent. Thereby, inner rib 21 can suppress occurrence of high stress in the vicinity of arm cylinder bracket 7*a*, in the same way as described above.

First Modification

Figure 6:
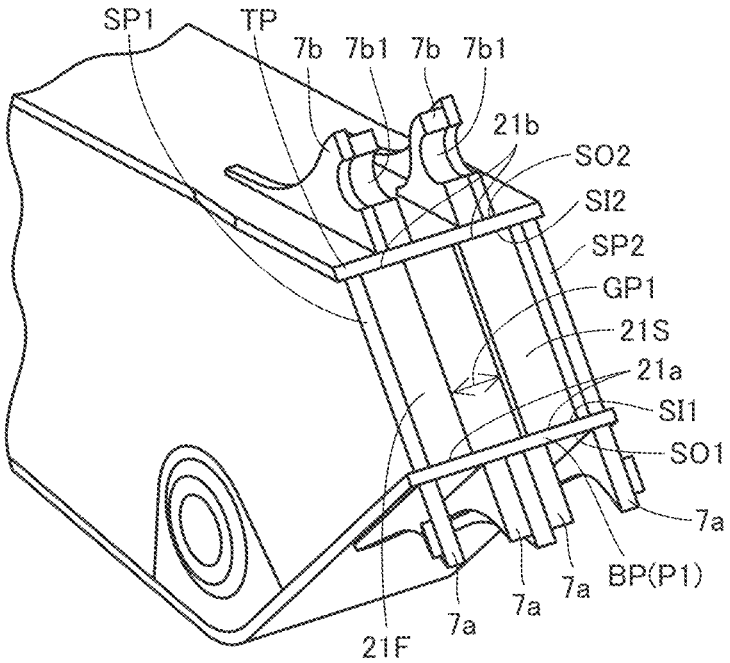
FIG. 6 is a schematic perspective cross-sectional view showing a configuration of a first modification, which is taken along a line VI-VI in FIG. 4.

The following describes the configuration of the first modification with reference to FIG. 6.

FIG. 6 is a schematic perspective cross-sectional view showing a configuration of the first modification, which is taken along a line VI-VI in FIG. 4. As shown in FIG. 6, inner rib 21 has two rib portions 21F and 21S. These two rib portions 21F and 21S are separated from each other in the left-right direction with a gap GP1 interposed therebetween.

Rib portions 21F and 21S each have a first end 21*a* connected to inner surface SI1 of first plate P1. Rib portions 21F and 21S each have a second end 21*b* connected to inner surface SI2 of upper plate TP. One side end of rib portion 21F is connected to the inner surface of side plate SP1. One side end of rib portion 21S is connected to the inner surface of side plate SP2. The other side end of rib portion 21F and the other side end of rib portion 21S face each other with gap GP1 interposed therebetween.

In a side view shown in FIG. 4, first end 21*a* of each of rib portions 21F and 21S is connected to the inner surface of first plate P1 within connection range RA between first plate P1 and arm cylinder bracket 7*a*. Further, in a side view shown in FIG. 4, first end 21*a* of each of rib portions 21F and 21S may be connected to the inner surface of first plate P1 within extension region RB in which the outer shape of arm cylinder 11 retracted to the maximum extent is extended in the extending direction of axis line SL of arm cylinder 11.

Further, in a side view shown in FIG. 4, first end 21*a* of each of rib portions 21F and 21S may be connected to the inner surface of first plate P1 within extension region RC in which the outer shape of through hole 7*a*1 is extended in the extending direction of axis line SL of arm cylinder 11 retracted to the maximum extent. Further, in a side view shown in FIG. 4, first end 21*a* of each of rib portions 21F and 21S may be connected to the inner surface of first plate P1 on the extension line of axis line SL of arm cylinder 11 retracted to the maximum extent.

First end 21*a* of each of rib portions 21F and 21S is disposed to face two arm cylinder brackets 7*a* sandwiching one arm cylinder 11 with first plate P1 interposed between each first end 21*a* and two arm cylinder brackets 7*a*.

Even if inner rib 21 is divided into a plurality of rib portions 21F and 21S in this manner, each of the plurality of rib portions 21F and 21S can support first plate P1 of lower plate BP from the inner surface SI1 side and can share the load received from arm cylinder 11. Thus, occurrence of high stress in the vicinity of arm cylinder bracket 7*a* can be suppressed in the same way as described above.

Second Modification

Figure 7:
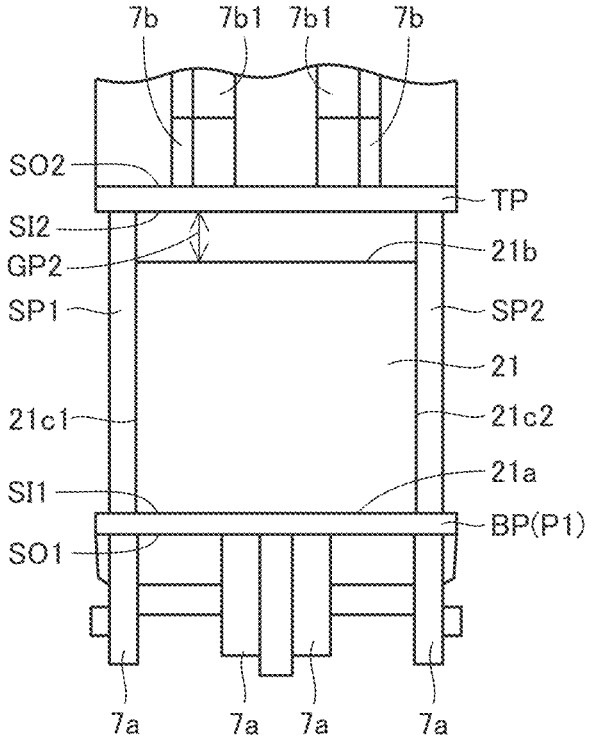
FIG. 7 is a schematic cross-sectional view showing a configuration of a second modification, which is taken along line VI-VI in FIG. 4.

The following describes the configuration of the second modification with reference to FIG. 7.

FIG. 7 is a schematic cross-sectional view showing a configuration of the second modification, which is taken along line VI-VI in FIG. 4. As shown in FIG. 7, if side ends 21*c*1 and 21*c*2 of inner rib 21 are connected to side plates SP1 and SP2, respectively, a gap GP2 may exist between second end 21*b* of inner rib 21 and inner surface SI2 of upper plate TP. In the second modification, second end 21*b* of inner rib 21 is not connected to inner surface SI2 of upper plate TP.

In the second modification, first plate P1 can be supported from the inner surface SI1 side by side plates SP1 and SP2 with inner rib 21 interposed between side plates SP1 and SP2. Thus, occurrence of high stress in the vicinity of arm cylinder bracket 7*a* can be suppressed.

Third Modification

Figure 8:
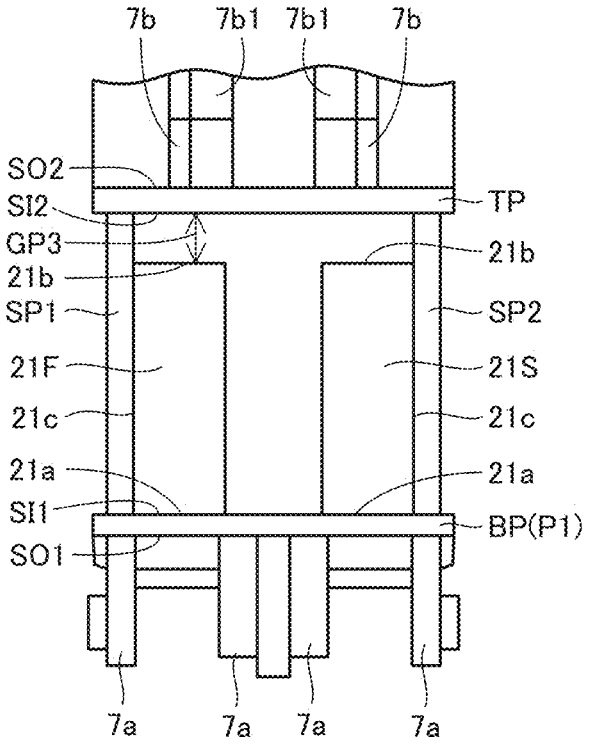
FIG. 8 is a schematic cross-sectional view showing a configuration of a third modification, which is taken along line VI-VI in FIG. 4.

The following describes the configuration of the third modification with reference to FIG. 8.

FIG. 8 is a schematic cross-sectional view showing a configuration of the third modification, which is taken along line VI-VI in FIG. 4. As shown in FIG. 8, also when inner rib 21 has two rib portions 21F and 21S, a gap GP3 may exist between second end 21*b* of each of rib portions 21F and 21S and inner surface SI2 of upper plate TP. In this case, one side end 21*c* of rib portion 21F is connected to side plate SP1. Also, one side end 21*c* of rib portion 21S is connected to side plate SP2.

In the third modification, first plate P1 can be supported from the inner surface SI1 side by side plates SP1 and SP2 with rib portions 21F and 21S interposed between side plates SP1 and SP2. Thus, occurrence of high stress in the vicinity of arm cylinder bracket 7*a* can be suppressed.

Further, in the above embodiment and modifications, inner rib 21 has been described as a plate-shaped member by way of example, but inner rib 21 may have a rod shape. Also, inner rib 21 has been described as a flat plate by way of example, but inner rib 21 may be a curved plate member.

Although a description has been made with regard to the configuration in which the pair of side ends 21*c* of inner rib 21 are respectively connected to side plates SP1 and SP2, when first end 21*a* of inner rib 21 is connected to first plate P1 and second end 21*b* of inner rib 21 is connected to upper plate TP, the pair of side ends 21*c* may not be respectively connected to side plates SP1 and SP2.

Although a description has been made with regard to the configuration in which the entire length of side end 21*c* from first end 21*a* to second end 21*b* of inner rib 21 is connected to side plate SP1 or SP2, only a part of the entire length of side end 21*c* may be connected to side plate SP1 or SP2.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 main body, 2 work implement, 3 revolving unit, 4 operator's cab, 4S operator's seat, 5 traveling unit, 5Cr crawler belt, 5M traveling motor, 6 boom, 7 arm, 7*a* arm cylinder bracket, 7*a*1, 7*b*1 through hole, 7*b* bucket cylinder bracket, 7*c* boom coupling boss, 7*d* bucket coupling boss, 7*e* link coupling boss, 8 bucket, 9 engine cover, 10 boom cylinder, 11 arm cylinder, 12 bucket cylinder, 13 boom foot pin, 14 boom top pin, 15 arm top pin, 16 link pin, 17 bucket link, 21, 22 inner rib, 21F, 21S rib portion, 21*a* first end, 21*b* second end, 21*c*, 21*c*1, 21*c*2 side end, 22*a* one end, 22*b* the other end, 31, 32 pin, 100 hydraulic excavator, BE1 bucket-side end portion, BP, BT lower plate, CP position, GP1, GP2, GP3 gap, IP internal space, P1 first plate, P2 second plate, RA, RD connection range, RB, RC extension region, RX revolving axis, SI1, SI2 inner surface, SO1, SO2 outer surface, SL axis line, SP1, SP2 side plate, TP upper plate.

The invention claimed is:

1. A work machine comprising:

a lower plate having a first outer surface and a first inner surface facing each other;

an upper plate having a second outer surface and a second inner surface facing each other, the upper plate being disposed such that the second inner surface faces the first inner surface at a distance from the first inner surface;

an arm cylinder bracket connected to the first outer surface of the lower plate;

an arm cylinder connected to the arm cylinder bracket; and a first inner rib disposed between the lower plate and the upper plate, the first inner rib being connected to the first inner surface of the lower plate within a first connection range between the lower plate and the arm cylinder bracket in a side view, wherein the first inner rib has a first end and a second end located opposite to the first end, and the first inner rib is connected at the first end to the first inner surface of the lower plate and connected at the second end to the second inner surface of the upper plate, and wherein, in a side view, the first end of the first inner rib is connected to the first inner surface of the lower plate within an extension region in which an outer shape of the arm cylinder retracted to a maximum extent is extended in an axial direction of the arm cylinder.

2. The work machine according to claim 1, further comprising a bucket cylinder bracket connected to the second outer surface of the upper plate, wherein in a side view, the second end of the first inner rib is connected to the upper plate within a second connection range between the upper plate and the bucket cylinder bracket.

3. The work machine according to claim 2, wherein, in a side view, the second end of the first inner rib is connected to a position located on the second inner surface of the upper plate and corresponding to a position on a bucket-side end portion of the bucket cylinder bracket connected to the second outer surface of the upper plate.

4. The work machine according to claim 1, further comprising a side plate connected to each of the lower plate and the upper plate, wherein the first inner rib includes a first end, a second end located opposite to the first end, and a side end connecting the first end and the second end, and the first inner rib is connected at the first end to the first inner surface of the lower plate, a gap exists between the second end of the first inner rib and the second inner surface of the upper plate, and the side end of the first inner rib is connected to the side plate.

5. The work machine according to claim 1, further comprising:

a boom coupling boss; and a second inner rib disposed between the lower plate and the upper plate and connected to the boom coupling boss.

6. The work machine according to claim 1, wherein the arm cylinder bracket has a through hole through which the arm cylinder is connected, and in a side view, the first end of the first inner rib is connected to the first inner surface of the lower plate within an extension region in which an outer shape of the through hole is extended in an axial direction of the arm cylinder retracted to a maximum extent.

7. The work machine according to claim 1, wherein, in a side view, the first end of the first inner rib is connected to the first inner surface of the lower plate on an extension line of an axis line of the arm cylinder retracted to a maximum extent.

8. The work machine according to claim 1, further comprising:

a main body that supports a work implement.

* * * * *